US006206332B1

(12) United States Patent
Middendorp et al.

(10) Patent No.: US 6,206,332 B1
(45) Date of Patent: Mar. 27, 2001

(54) CLAMPING DEVICE

(75) Inventors: Oscar Middendorp, Nieuwerkerk aan den Ijssel; Bastiaan Gourdiaan, Vlaardingen, both of (NL)

(73) Assignee: InnoEssentials International B.V. (NL)

( * ) Notice: Subject to any disclaimer, the term of this patent is extended or adjusted under 35 U.S.C. 154(b) by 0 days.

(21) Appl. No.: 09/470,017

(22) Filed: Dec. 22, 1999

Related U.S. Application Data

(63) Continuation of application No. PCT/NL98/00355, filed on Jun. 19, 1998.

(30) Foreign Application Priority Data

Jun. 26, 1997 (NL) ..... 1006409
Apr. 7, 1998 (NL) ..... 1008830

(51) Int. Cl.[7] ..... A47G 1/17
(52) U.S. Cl. ..... 248/316.1; 248/313; 211/89.01
(58) Field of Search ..... 248/216.1, 313, 248/309.1, 316.1, 110, 111, 113; 24/115 G, 136 R; 211/89.01, 6, 65, 68, 69.1

(56) References Cited

U.S. PATENT DOCUMENTS 1,204,457 * 11/1916 Kreeft ..... 439/817
1,646,068 * 10/1927 Rosner ..... 248/316.4
2,457,274 * 12/1948 Rifken ..... 248/314
4,794,673 * 1/1989 Yamaguchi ..... 24/115 G
5,008,981 4/1991 Smithson .
5,361,461 * 11/1994 Anscher ..... 24/115 G
5,365,641 * 11/1994 Watanabe et al. ..... 24/115 G
5,621,952 * 4/1997 Frano ..... 24/115 G
5,649,340 * 7/1997 Ida ..... 24/115 G
5,671,505 * 9/1997 Anscher ..... 24/115 G
5,711,032 * 1/1998 Carpenter ..... 2/158
5,737,808 * 4/1998 Ikeda ..... 24/115 G
6,018,851 * 2/2000 Anscher ..... 24/115 G
6,026,548 * 2/2000 Jackson ..... 24/712
6,038,746 * 3/2000 Anscher et al. ..... 24/115 G

FOREIGN PATENT DOCUMENTS 808 628 7/1951 (DE) .
81 14 063 9/1985 (DE) .
1276059 10/1961 (FR) .

* cited by examiner

*Primary Examiner*—Anita M. King
*Assistant Examiner*—N. Morrison
(74) *Attorney, Agent, or Firm*—Reising, Ethington, Barnes, Kisselle, Learman & McCulloch, P.C.

(57) ABSTRACT

Clamping device for clamping somewhat flexible products, such as towels, comprising: a wall-mounted holder part (101) with an insertion opening (105), an operating holder part (102) with an insertion opening (106), which holder parts (101, 102) fit at least partially displaceably inside one another, and a spring member (103) which preloads the holder parts (101, 102) in a clamping position, it being possible to displace the holder parts (101, 102) with respect to one another counter to the action of the spring member (103), in such a manner that the insertion openings (105, 106) in the holder parts (101, 102) in one position at least partially correspond to one another and form a continuous insertion opening into which part of the flexible product can be inserted, in which clamping device the two holder parts (101, 102) are of essentially hollow design and together delimit an internal space, and in which clamping device one of the holder parts (101, 102) is provided with an auxiliary part (110) which is placed in the internal space, one end of the spring member (103) being supported against the auxiliary part (110) and the auxiliary part (110) shielding the spring member (103) from the internal space in the holder parts (101, 102), which is accessible via the insertion openings (105, 106).

18 Claims, 10 Drawing Sheets

CLAMPING DEVICE

CROSS-REFERENCE TO RELATED APPLICATIONS

This is a continuation application to PCT/NL 98/00355 filed Jun. 19, 1998.

FIELD OF THE INVENTION

The invention relates to a clamping device for clamping somewhat flexible products, such as towels, comprising: a wall-mounted holder part with an insertion opening, an operating holder part with an insertion opening, which holder parts fit at least partially displaceably inside one another, and a spring member which preloads the holder parts in a clamping position, it being possible to displace the holder parts with respect to one another counter to the action of the spring member, in such a manner that the insertion openings in the holder parts in one position at least partially correspond to one another and form a continuous insertion opening into which part of the flexible product can be inserted.

BACKGROUND OF THE INVENTION

A clamping device of this kind is known from DE-U-81 14 063. The known clamping device comprises a hollow cylindrical wall-mounted holder part, in which a solid cylindrical operating holder part can slide to and fro. A spring is accommodated between the two holder parts. The spring is supported on one side on the bottom of the hollow cylindrical wall-mounted holder part and on the other side in a recess which is formed in the solid cylindrical operating holder part. Furthermore, the operating holder part is provided with a locking finger which extends downwards and is intended to engage in locking projections arranged on the bottom of the wall-mounted holder part. The connection between the locking finger and the locking projections is such that limited movement between the two holder parts is possible. The hollow cylindrical wall-mounted holder part is provided with a slot-shaped insertion opening, while the solid cylindrical operating holder part is provided with a slot-shaped recess. By pressing the operating holder part inwards into the wall-mounted holder part, counter to the spring force, the insertion opening and the recess will move into line with one another. At that moment, part of a somewhat flexible product can be inserted. If the operating holder part is then pressed outwards again by the spring loading, that part of the product which has been inserted will be clamped between the edges of the insertion opening in the wall-mounted holder part and the edges of the recess in the operating holder part.

A drawback of this known clamping device is that the operating holder part is of substantially solid design and therefore does not have a uniform wall thickness corresponding to the wall thickness of the wall-mounted holder part. This entails high production costs and often the need to use different materials for the holder parts. Furthermore, the solid operating holder part lies inside the hollow wall-mounted holder part. Each time it is used, dirt from the hand of a user can as a result pass between the two holder parts. The accumulated dirt source produced in this way causes unhygienic conditions, which is undesirable when the clamping device is used for towels and the like. Furthermore, the dirt which penetrates between the two holder parts may have the result that the clamping device can no longer operate effectively, for example because the holder parts can only be moved with great difficulty with respect to one another.

SUMMARY OF THE INVENTION

The object of the present invention is to provide a clamping device which eliminates these drawbacks.

According to the invention, this object is achieved by means of a clamping device according to claim 1. By making the two holder parts of hollow design, they together delimit an internal space. According to the invention, an auxiliary part is placed in the internal space formed in this way, which auxiliary part is joined to one of the two holder parts. The auxiliary part has a dual function and serves to support one end of the spring member and, in addition, to shield the spring member from the internal space which is accessible via the insertion openings. As a result, both holder parts can be produced with a substantially uniform wall thickness and from the same material. This saves considerably on production costs. Due to the fact that the auxiliary part shields the spring member, it is no longer possible for part of a flexible product which has been inserted via the insertion openings to become clamped in the spring member. According to the invention, the operating holder part is of larger design, so that it slides over the wall-mounted holder part. Any dirt which passes onto the operating surface of the operating holder part can easily be removed with a cloth without the risk of the dirt passing between the two holder parts.

Preferred embodiments of the invention are described in claims 2–18.

BRIEF DESCRIPTION OF THE DRAWINGS

The invention will be explained in more detail with reference to the appended drawing, in which.

DETAILED DESCRIPTION OF THE PREFERRED EMBODIMENTS

Figure 1A:
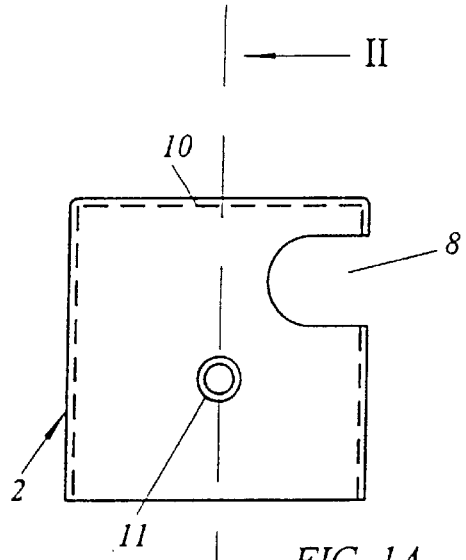
FIGS. 1A, 1B respectively show a side view and a front view of an operating holder part.
Figure 1B:
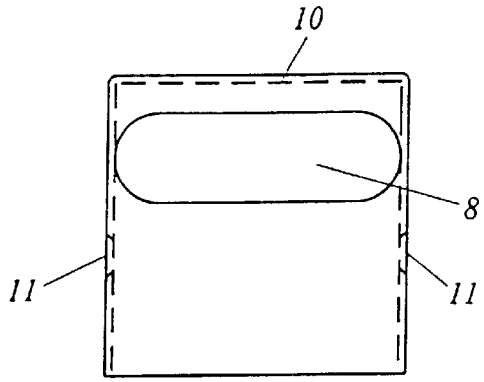
Figure 1C:
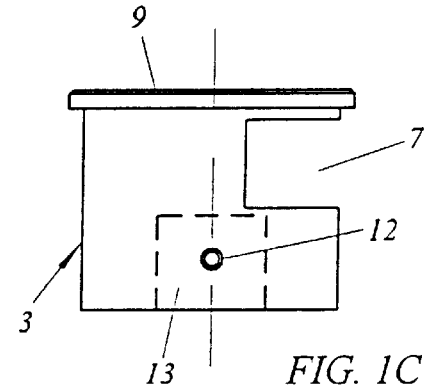
FIGS. 1C, 1D respectively show a side view and a front view of an auxiliary part.
Figure 1D:
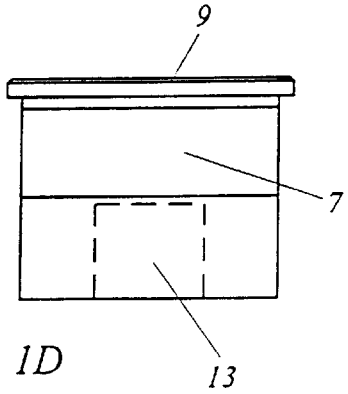
Figure 1E:
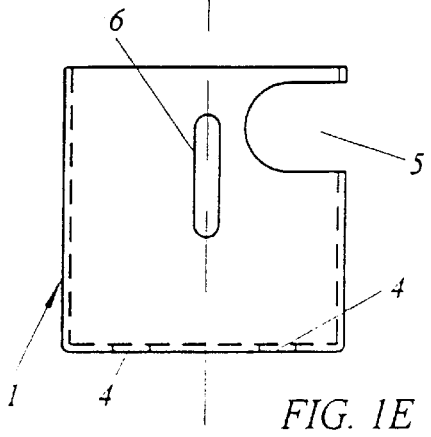
FIGS. 1E, 1F respectively show a side view and a front view of a wall-mounted holder part.
Figure 1F:
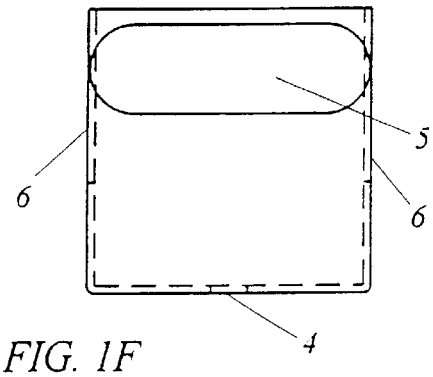

In FIG. 1, the wall-mounted holder part of the device, which is intended to be placed against a wall or frame, is denoted by 1, while the operating holder part, which can move with respect to the fixed part, is denoted by 2 and the auxiliary part arranged in the operating holder part is denoted by 3.

The wall-mounted holder part 1 is provided with at least two holes 4 for fastening screws, by means of which the wall-mounted holder part 1 can be attached in a fixed position to a wall. Furthermore, the wall-mounted holder part 1 has an insertion opening 5, which, together with the insertion openings 7, 8 in the auxiliary part 3 and the operating holder part 2, respectively, is intended to hold a towel or similar article.

The auxiliary part 3 is provided on the top side with a collar 9, which when the auxiliary part 3 is fastened in the operating holder part 3 bears against the inside 10. Preferably, the auxiliary part 3 is made from a plastic, and the holder parts 1, 2 are made from metal. Since the holder parts are visible, they may furthermore be decorated, for example by being chromium-plated.

The auxiliary part 3 can be successfully attached to the operating holder part 2 by adhesively bonding the top surface of the collar 9 to the inside 10.

The operating holder part 2 is attached such that it can move with respect to the wall-mounted holder part 1, with the aid of screws or locking pins (not shown in more detail) which are inserted, through openings 11 in the operating holder part 2 and slots 6 in the wall-mounted holder part, into holes 12 in the auxiliary part 3.

Figure 2:
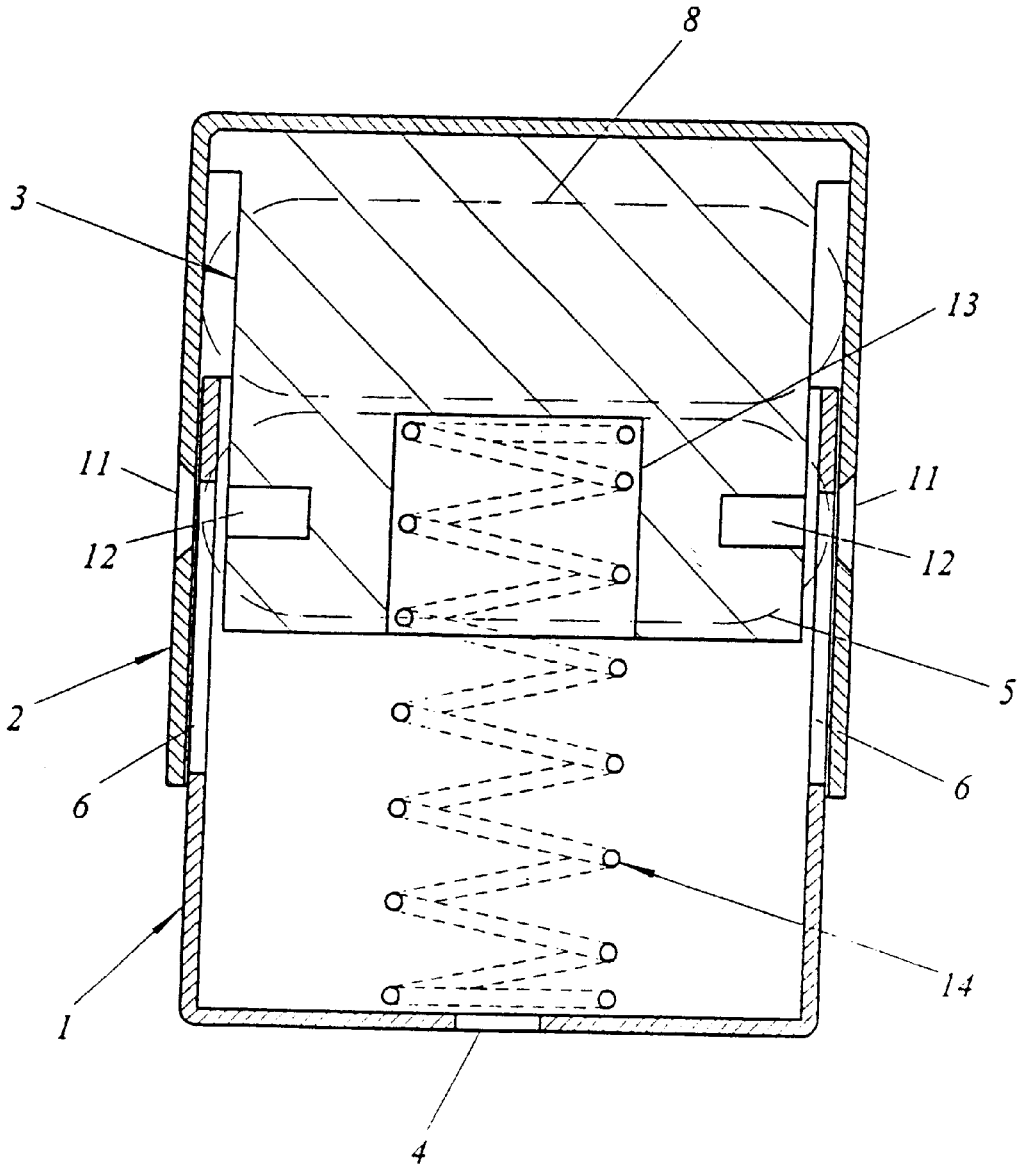
FIG. 2 shows a cross-section on line II—II of an assembled clamping device.
Figure 3A:
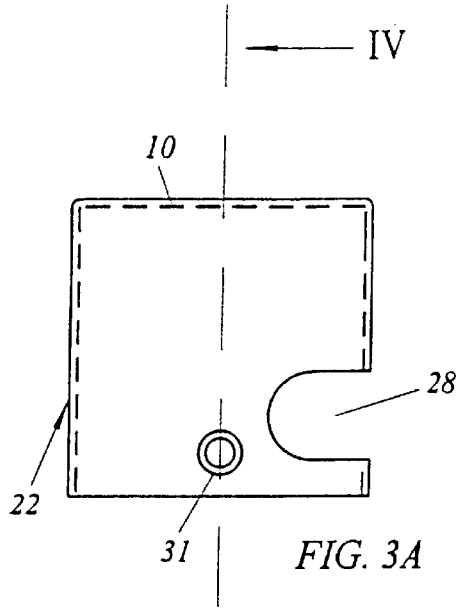
FIGS. 3A, 3B respectively show a side view and a front view of an operating holder part of a second embodiment.
Figure 3B:
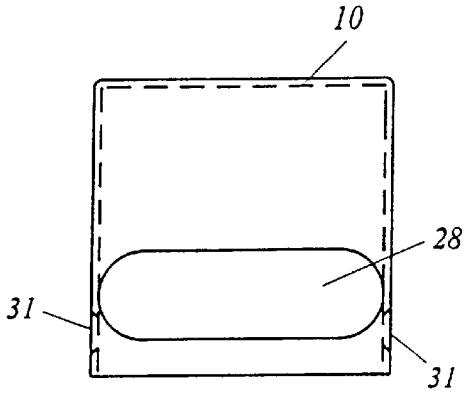
Figure 3C:
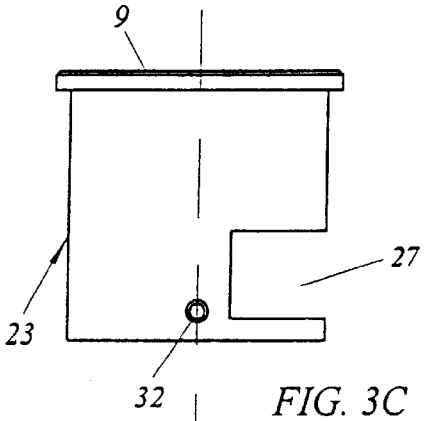
FIGS. 3C, 3D respectively show a side view and a front view of an auxiliary part of the second embodiment.
Figure 3D:
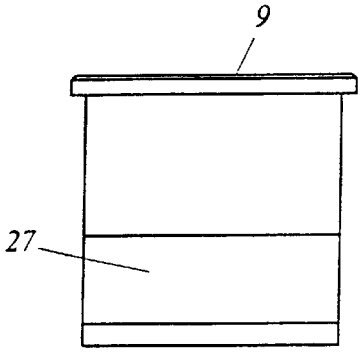
Figure 3E:
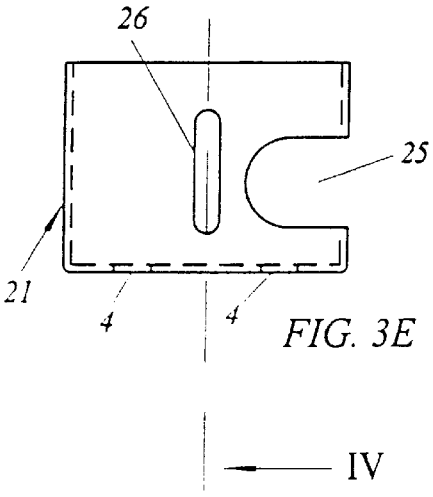
FIGS. 3E, 3F respectively show a side view and a front view of a wall-mounted holder part of the second embodiment.
Figure 3F:
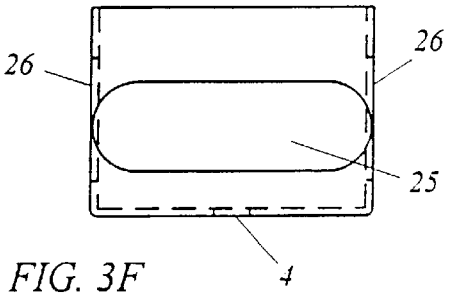

A recess 13 is arranged centrally on the underside of the auxiliary part 3, so as to be able to partially accommodate a spring 14 (cf. FIG. 2). The other end of the spring 14 bears against the bottom of the wall-mounted holder part 1. In principle, it is also possible to allow a spring to act between the underside of the wall-mounted holder part 1 and the bottom of the auxiliary part 3, but in that case it will be necessary to attempt to find a significantly shorter spring which nevertheless has approximately the right spring characteristic.

FIG. 2 shows a cross-section, on line II—II in FIG. 1, of the clamping device, with the auxiliary part 3 attached in the operating holder part 2, for example by adhesive bonding, and with the spring 14 positioned between the bottom of the wall-mounted holder part 1 and the auxiliary part 3, the spring being partially accommodated in the recess 13.

Between the operating holder part 2 and the auxiliary part 3, a hollow cylindrical guide is formed where a section of the top side of the wall-mounted holder part is fitted. The movement of the parts 1, 2, 3 with respect to one another is determined by the distance through which the locking means (not shown in more detail) can move in the slots 6.

The positions of the insertion openings 5 and 8 are indicated by dashed lines, the insertion opening, that is to say the slot 7 in the auxiliary part 3, coinciding with the border of the insertion opening 8 in the operating holder part 2. The clamping device is shown in the extreme upper position, in which the insertion openings 5, 8 in the wall-mounted holder part 1 and the operating holder part 2, respectively, do not overlap one another at all.

FIG. 3 shows a second embodiment which comprises a wall-mounted holder part 21, an operating holder part 22 and an auxiliary part 23 which is to be arranged in the operating holder part 22. The respective parts 21, 22, 23 are provided with insertion openings 25, 27, 28. By comparison with the first embodiment, these insertion openings 25, 27, 28 are moved further towards the bottom, i.e. the insertion opening into which the towel is to be inserted is situated closer to the wall or the frame to which the clamping device is attached.

The openings 31, 32 in the operating holder part 22 and in the auxiliary part 23, and also the slots 26 in the wall-mounted holder part, are shifted downwards with respect to the first embodiment.

Figure 4:
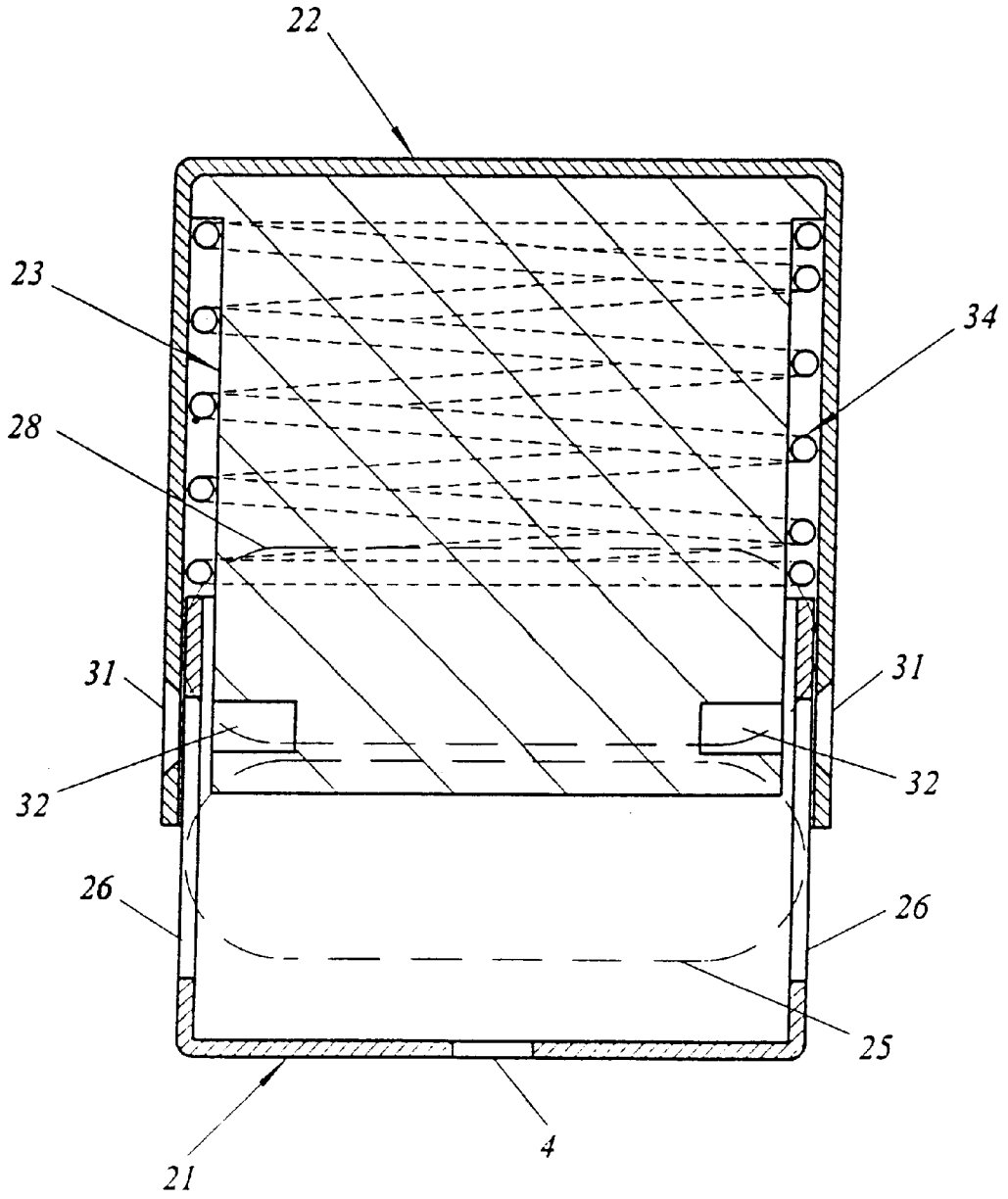
FIG. 4 shows a cross-section on line IV—IV of an assembled second embodiment.
Figure 5A:
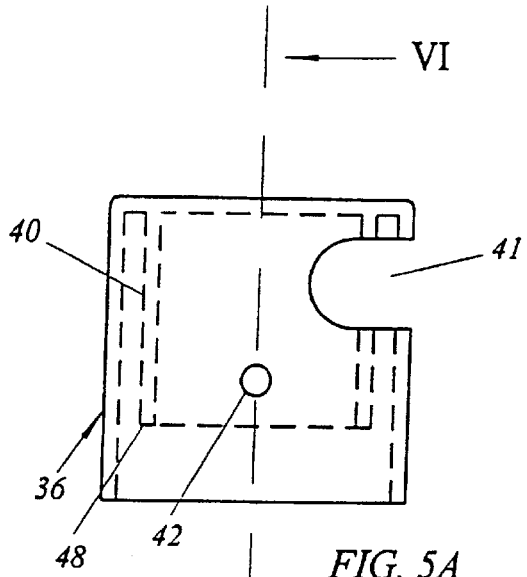
FIGS. 5A, 5B respectively show a side view and a front view of an operating holder part of a third embodiment.
Figure 5B:
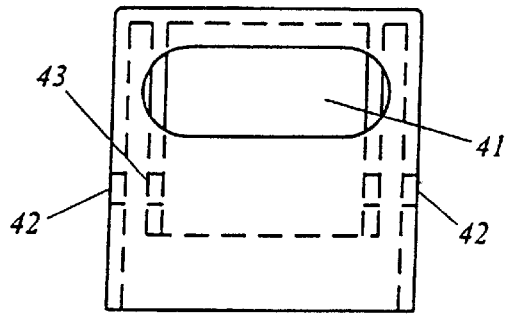
Figure 5C:
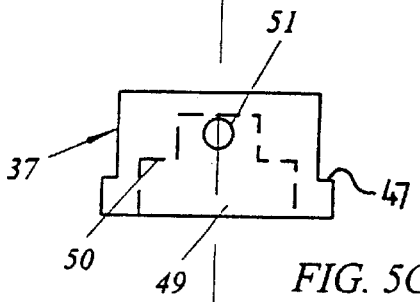
FIGS. 5C, 5D respectively show a side view and a front view of an auxiliary part of the third embodiment.
Figure 5D:
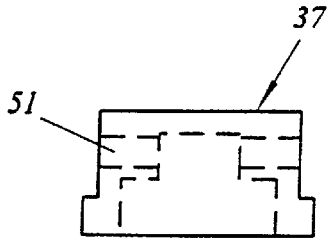
Figure 5E:
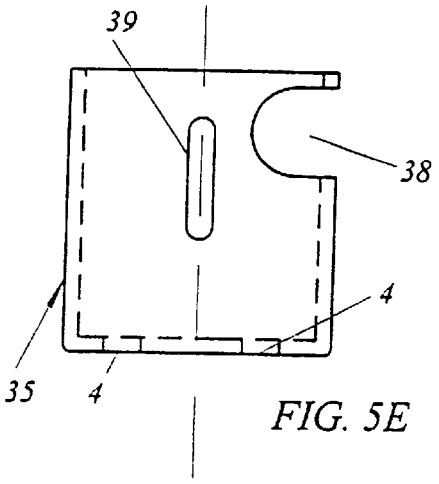
FIGS. 5E, 5F respectively show a side view and a front view of a wall-mounted holder part of the third embodiment.
Figure 5F:
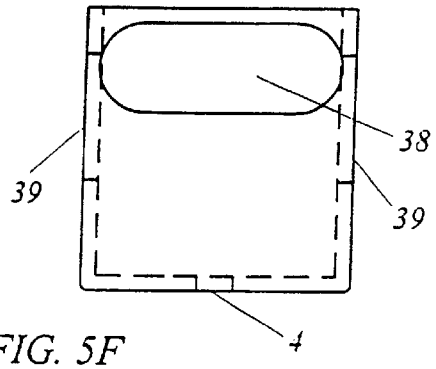

Furthermore, the auxiliary part 23 is longer than the auxiliary part 3 of the first embodiment, and the wall-mounted holder part 21 is slightly shorter than the wall-mounted holder part 1 of the first embodiment. Also, a recess for partially accommodating a spring member is not provided on the underside of the auxiliary part 23, since in the second embodiment the spring member is placed in the hollow cylindrical space formed between the operating holder part 22 and the auxiliary part 23 (cf. FIG. 4).

The cross-section of FIG. 4 again shows the respective insertion openings 25, 28 in the wall-mounted holder part 21 and the operating holder part 22, with the parts again in a limit position. The spring member 34 is now situated between the edge of the wall-mounted holder part 21 and the collar 9 of the auxiliary part 23, where there is sufficient space to be able to execute the required movement and also still to have sufficient room for the turns of the spring 34.

In order to have sufficient space in the radial direction for the spring, it is possible in a simple manner to reduce the diameter of the auxiliary part and increase the wall thickness of the wall-mounted holder part.

FIG. 5 shows an embodiment which is specifically intended to be produced by means of injection moulding. The wall-mounted holder part 35 largely corresponds to the wall-mounted holder part of the first embodiment, the only differences lying in the wall thickness and the associated dimensions.

The operating holder part 36 is integral with the sleeve 40 situated inside it. An insertion opening which precisely corresponds to the insertion opening 41 in the operating holder part 36 is arranged in the sleeve 40. Furthermore, a fitting piece 37 is provided, which fitting piece is intended to be accommodated in the sleeve 40, the shoulder 47 coming to lie against the edge 48 of the sleeve 40. The fitting piece 37 is furthermore provided with a recess 49 with shoulder 50 for accommodating one end of a spring member 46 (cf. FIG. 6).

The fitting piece 37 is furthermore provided with holes 51 which, when correctly positioned in the sleeve 40, are aligned with the holes 42, 43 in the operating holder part 36 and the sleeve 40, respectively.

Figure 6:
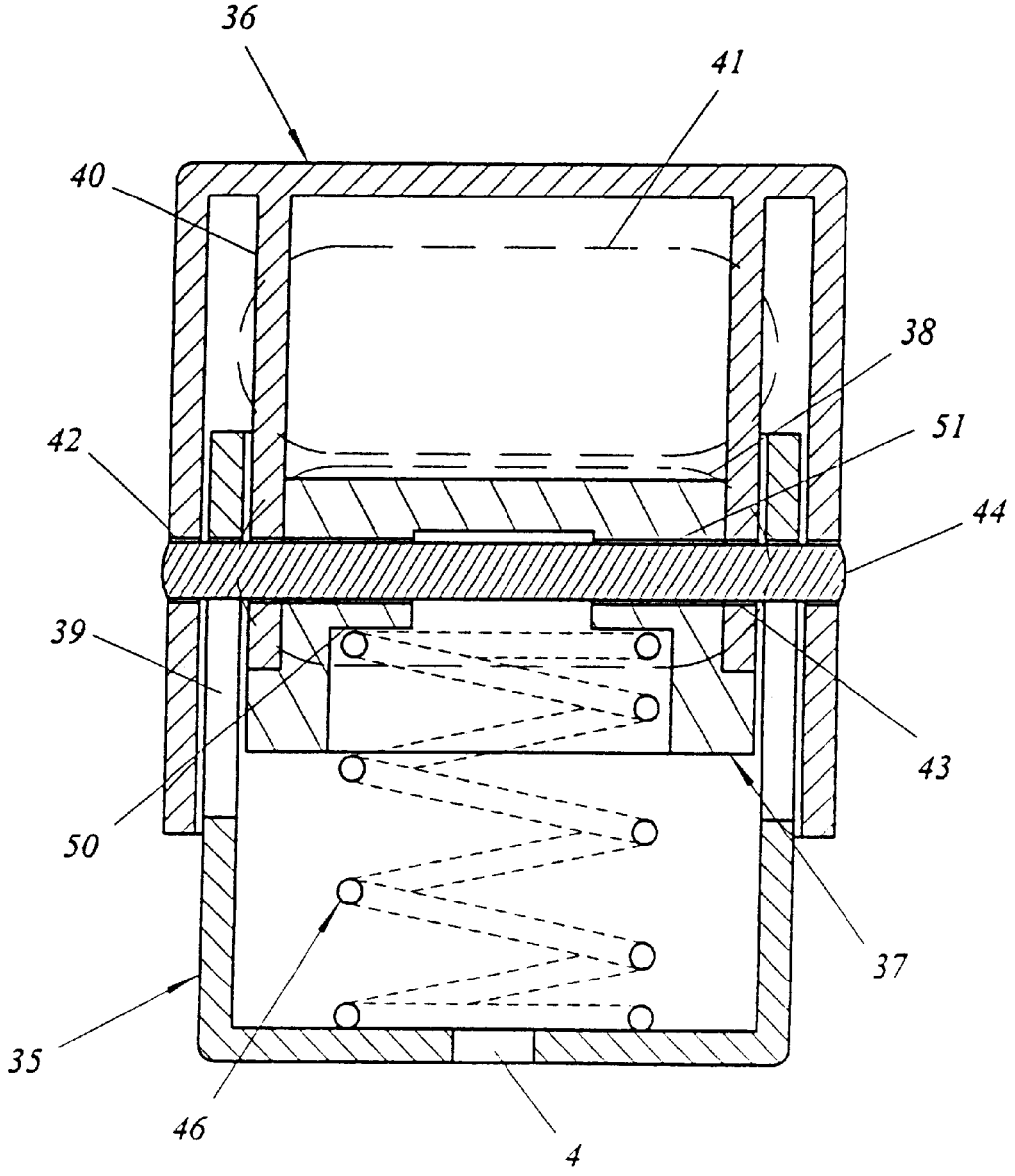
FIG. 6 shows a cross-section on line VI—VI of an assembled third embodiment.
Figure 7:
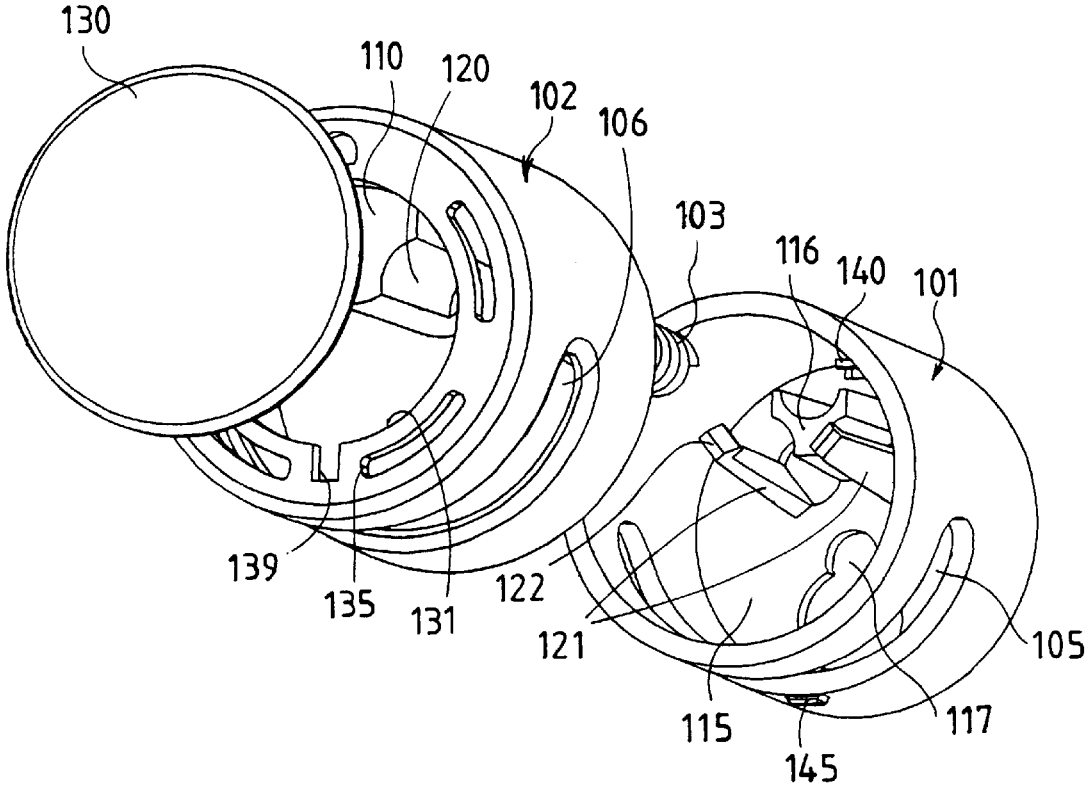
FIG. 7 shows a perspective, exploded view of a preferred embodiment of the clamping device according to the invention.
Figure 8:
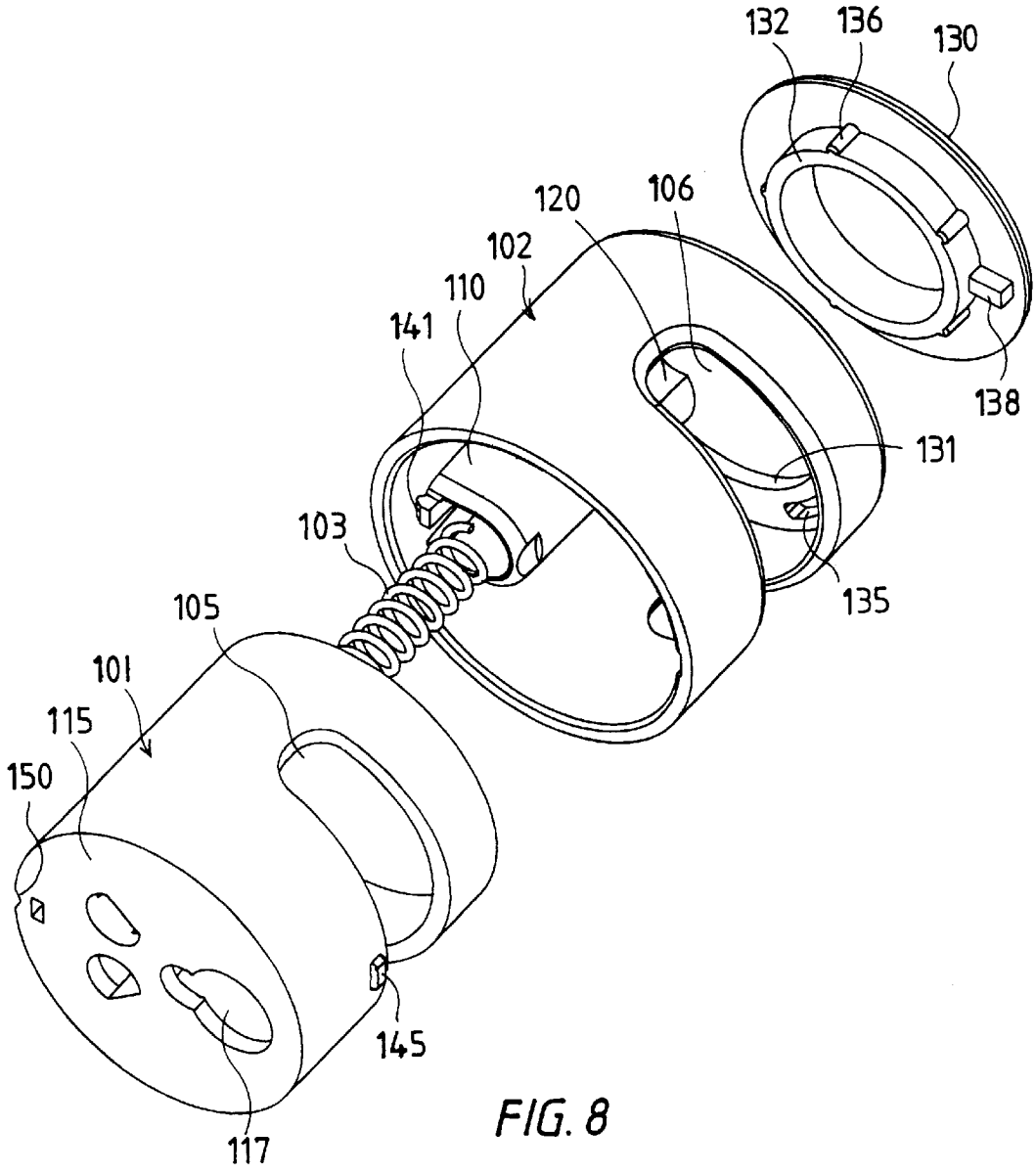
FIG. 8 shows a view corresponding to that of FIG. 7, seen from the side of the wall-mounted holder part.

The cross-section of FIG. 6 shows an assembled clamping device. First of all, the fitting piece 37 is placed in the sleeve 40 of the operating holder part 36, and then the operating holder part 36, provided with fitting piece 37 and spring 46, is pushed over the wall-mounted holder part 35, and finally the pin 44 is pushed through the holes 42, 43, 51 in the operating holder part 36, the sleeve 40 and the fitting piece 37, respectively, and the slots 39 in the wall-mounted holder part 35, which are situated between the holes 42 and 43.

The most important difference from the first two embodiments is that in this embodiment the auxiliary part is composed of the sleeve 40 and the fitting piece 37, the sleeve being integral with the operating holder part 36. Furthermore, the dimensions of sleeve 40 and fitting piece 37 are selected in such a manner that there is sufficient space between the shoulder 50 of the fitting piece, against which the spring member bears, and the underside of the opening 41 to allow a continuous pin 44 to pass through.

The abovementioned three embodiments operate as follows. After the operating holder part has been moved with respect to the wall-mounted holder part counter to the action of the spring member until a continuous insertion opening is produced, a towel or the like which is to be hung in the device can be introduced into the insertion opening, after which the operating holder part can be released. As a result, the holder parts move apart and the towel is then firmly clamped between the two holder parts. As will be clear, the towel can easily be removed from the clamping device by pressing in the operating holder part.

The abovementioned three embodiments have a number of advantages. Firstly, the design comprising the auxiliary part ensures that the parts are correctly guided, with the result that there is no possibility of the parts becoming tilted with respect to one another and consequently becoming jammed.

A further advantage is that the towel projects through three insertion openings, of which the insertion openings in the operating holder part and the auxiliary part precisely correspond to one another and adopt a fixed position with respect to one another, but may be offset with respect to the third insertion opening in the wall-mounted holder part positioned between the operating holder part and the auxiliary part. During clamping, the edges of the innermost and outermost insertion openings exert a force on the towel, while the edges of the insertion opening positioned between them takes care of the counter-force, while the close fit means that the towel cannot become folded and trapped between side faces of the parts, possibly resulting in damage.

A final advantage which may be mentioned is that in this design the spring member can be kept entirely outside that part of the device where the insertion openings are arranged. Therefore, when the towel is inserted into the insertion openings, it is in no way impeded by a part of a spring member situated at a certain distance behind the insertion openings.

The connecting means, which in this case comprise locking pins or screws, can be attached after the wall-mounted holder part has been fixed, for example, to a wall and the operating holder part including auxiliary part and spring member has been placed over the wall-mounted holder part.

The holder parts, which are easy to produce, are preferably of cylindrical form. The auxiliary part required is preferably produced separately and joined fixedly to the operating holder part, for example by adhesive bonding.

The clamping device can be fastened with the insertion openings facing downwards, in which case a corner of the towel to be suspended should be pushed through the insertion openings, after which the towel can hang aesthetically downwards. However, it is also possible for the insertion openings to emerge substantially along the side of the clamping device, so that the insertion openings are visible, thus facilitating hanging the towel in the device, since one edge thereof can easily be placed in the insertion openings.

Since the clamping device projects slightly, the free end of the operating holder part may be rounded, with the result that any contact between a part of the body and the device brought about, for example, by an accidental movement will be less painful than if the end has sharp edges.

Figure 11:
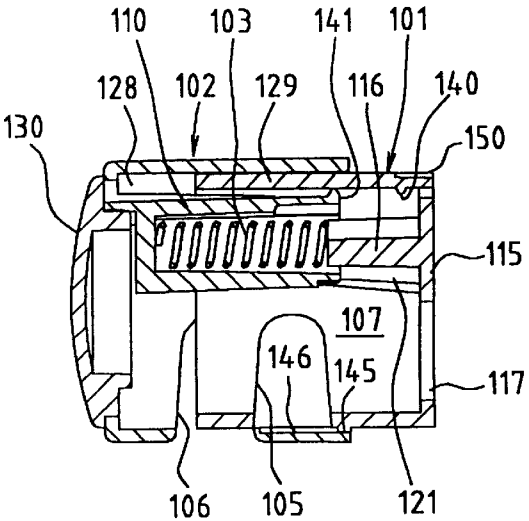
FIG. 11 is a cross-sectional view on line XI—XI in FIG. 10.
Figure 10:
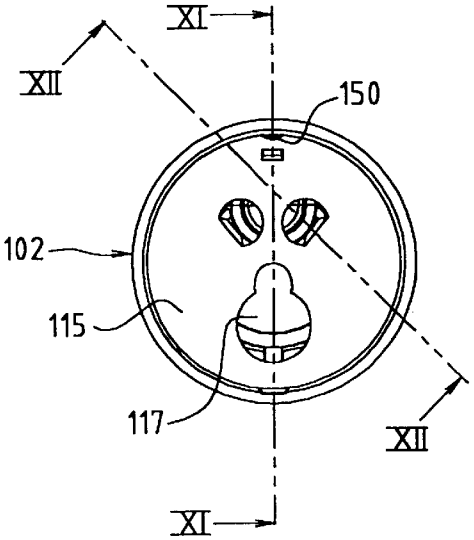
FIG. 10 is a rear view of FIG. 9.
Figure 9:
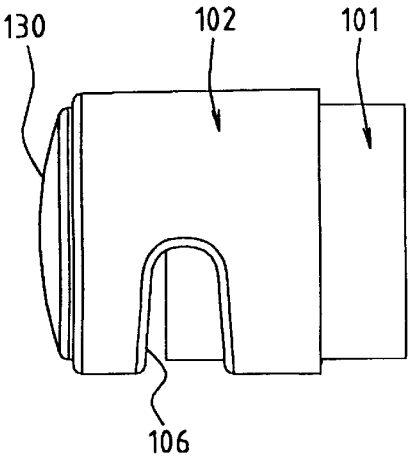
FIG. 9 shows a side view of the clamping device shown in FIGS. 7 and 8, with the parts assembled.
Figure 16:
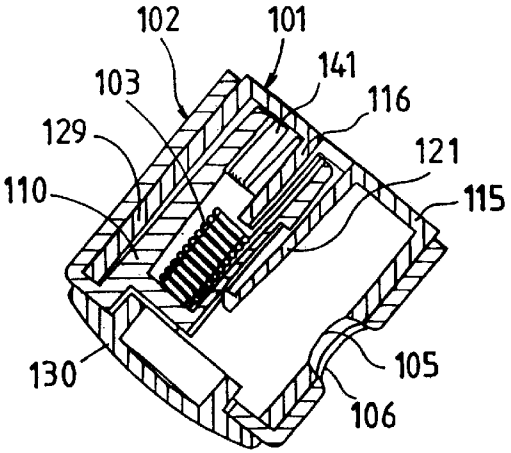
FIG. 16 is a cross-sectional view on line XVI—XVI in FIG. 14.

In FIGS. 7–16, the clamping device comprises a wall-mounted holder part 101, an operating holder part 102 and a spring member 103. The wall-mounted holder part 101 has an insertion opening 105, and the operating holder part 102 has an insertion opening 106. The two holder parts 101, 102 are substantially hollow and together, in the assembled state, delimit a hollow internal space 107 (FIG. 11). The operating holder part 102 has a sleeve-like spring housing 110 positioned in the internal space. The spring housing 110 is advantageously integral with the operating holder part 102, but may also be joined thereto, for example by means of adhesive bonding. The spring housing 110 is open at one end and closed at the other end. The holder parts 101, 102 fit displaceably into one another, the outer circumferential wall of the operating holder part 102 sliding over the wall-mounted holder part 101. In the assembled state, the spring member 103 presses the holder parts 101, 102 apart (FIGS. 9–12). The holder parts 101, 102 can be displaced with respect to one another counter to the action of the spring member 103 (FIGS. 13–16). As a result, the insertion openings 105, 106 are aligned with one another and form a continuous insertion opening, into which part of a flexible product, for example the corner of a towel, can be inserted. By then releasing the operating holder part 102, the spring member will press the holder parts 101, 102 apart towards a clamping position.

Figure 15:
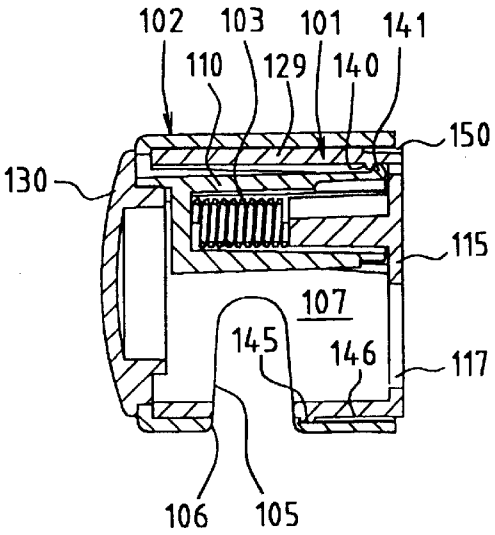
FIG. 15 is a cross-sectional view on line XV—XV in FIG. 14.
Figure 14:
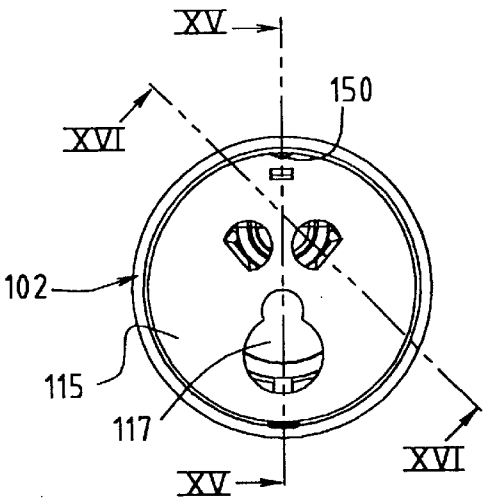
FIG. 14 is a rear view of FIG. 13.
Figure 13:
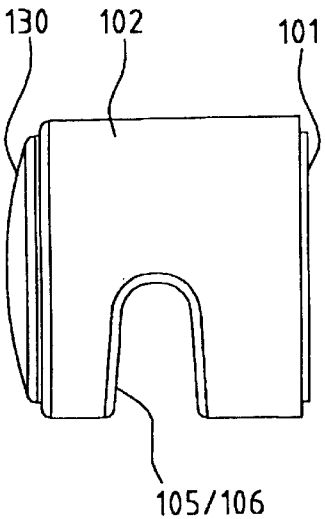
FIG. 13 is a side view in accordance with FIG. 9 in the clicked-in position.

As can be seen in FIG. 11, the spring member 103 comprises a slender coil spring, the dimensions of which are small by comparison with the total volume of the internal space. The whole of the slender coil spring is accommodated in the sleeve-like spring housing 110. The wall-mounted holder part 101 has a bottom 115. The bottom 115 has a spring-stop element 116 which projects inwards into the internal space. As can be seen in FIG. 11, the spring-stop element 116 projects inwards into the spring housing 110. If the holder parts 101, 102 slide over one another, the spring-stop element 116 will slide inwards into the spring housing 110, with the result that the spring member 103 is compressed (FIG. 15). In this way, the spring member 103 is enclosed in the spring housing 110 and is advantageously shielded from the internal space which is accessible via the insertion openings 105, 106. As a result, a section of a flexible product which has been pushed inwards via the insertion openings 105, 106 cannot become trapped between the turns of the coil spring.

Figure 12:
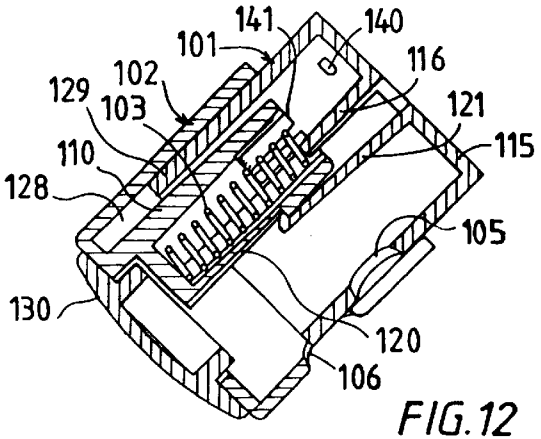
FIG. 12 is a cross-sectional view on line XII—XII in FIG. 10.

The circumferential wall of the spring housing 110 is provided with two guide slots 120. The wall-mounted holder part 101 contains two guide fingers 121 which extend inwards into the internal space from the bottom 115. In the assembled state of the holder parts 101, 102, the guide fingers 121 engage displaceably in the guide slots 120. At their free ends, the guide fingers 121 are provided with studs 122. These studs 122 ensure that the spring member 103 cannot press the holder parts 101, 102 further apart than the position shown in FIGS. 9–12, due to the fact that in this position the studs 122 bear against the ends of the guide slots 120 (FIG. 12).

The spring housing 110 and the spring-stop element 116 are arranged eccentrically in the holder parts 101, 102 in question, in the region of the walls situated opposite the insertion openings 105, 106. As a result, on the one hand there is a larger internal space available for a flexible product which is to be pushed inwards via the insertion openings 105, 106, and on the other hand there is space on the bottom 115 of the wall-mounted holder part 101 for a slotted hole 117, by means of which the clamping device can be screwed fixedly onto a wall. In a variant, the bottom is provided with a double-sided adhesive strip, by means of which, after a protective film has been removed, the clamping device can be quickly stuck to a wall. As can be seen in FIG. 11, a gap 128 for accommodating a wall section 129 of the wall-mounted holder part 101 is left between the eccentrically arranged spring housing 110 and the wall of the operating holder part 102. This enclosure for the wall section 129, together with the oppositely situated bearing between the two guide fingers 121 and the guide slots 120 of the spring housing 110, ensures that the holder parts 101, 102 are guided correctly with respect to one another without any possibility of them becoming trapped as a result of becoming tilted.

In a variant which is not shown, the spring housing is connected to the wall-mounted holder part, while the spring-stop element is connected to the operating holder part.

Advantageously, the operating holder part 102 is provided with an exchangeable cap 130. As a result, the cap 130 can be replaced easily with caps which are provided with different colours matched to the interior decor, or which are provided, for example, with cartoon characters or the like which are attractive to children. Due to the fact that the spring member 103 is delimited towards the side of the cap 130 by a closed end of the spring housing 110, the outer end of the operating holder part 102 may advantageously be of open design. In the embodiment shown, the outer end of the operating holder part 102 is provided with a continuous cutout 131 into which a clamping edge 132 of the cap 130 can engage in a clamped manner. By providing the wall parts in the region of the cutout 131 with slot-like holes 135 and providing the clamping edge 132 with small protrusions 136, a resilient fit is produced between the cap 130 and the operating holder part 102. This resilient fit makes it easier to attach and remove the cap 130. The cap is furthermore provided with a positioning stud 138, which is intended to engage in a complementary recess 139 in the outer end of the operating holder part 102. The removable cap 130, together with the open cutout 131 in the outer end of the operating holder part 102, advantageously ensure that the internal space 107 delimited by the holder parts 101, 102 remains accessible even when the clamping device is mounted on the wall. This is useful when screwing the device onto the wall, but may also be used to remove any objects which have accidentally penetrated into the clamping device.

In order to indicate to a user who is pressing in the operating holder part 102 that the insertion openings 105, 106 are aligned with one another, it is possible according to the invention to provide clicking means for producing an audible signal as soon as this position is reached. The clicking means comprise, for example, a clicking stud 140 arranged in the wall-mounted holder part 101 and a resilient clicking finger 141 arranged in the operating holder part 102. When the clicking stud 140 and the clicking finger 141 are pushed over one another, a click will be heard (FIGS. 11 and 15).

In order to prevent rotation of the holder parts 101, 102 with respect to one another, the wall-mounted holder part is provided with a guide stud 145 which engages in a guide groove 146 in the operating holder part 102. The guide groove 146 extends in the sliding direction.

The wall-mounted holder part 101 is provided with a mark 150 which lies directly opposite the centre of the insertion openings 105, 106. When the clamping device is being attached to a wall, the mark 150 can be used to position the insertion openings correctly.

In this way, the invention provides a very advantageous embodiment of a clamping device for hanging towels and the like. The clamping device is easy to produce using one material by means of injection moulding while maintaining a uniform wall thickness for the various components. If the spring sleeve, as in the embodiment shown in FIGS. 7–16, is integral with the operating holder part, the clamping device comprises only four components: a wall-mounted holder part, an operating holder part, a spring member and an exchangeable cap. In this case, the operating holder part may advantageously, just like the wall-mounted holder part, be produced in a single injection-moulding step with a substantially uniform wall thickness. The clamping device is easy to operate and hygienic to use. Moreover, the clamping device can easily be matched to anyone's wishes by means of the exchangeable cap.

What is claimed is:

1. Clamping device for clamping somewhat flexible products, comprising: a wall-mounted holder part with an insertion opening, an operating holder part with an insertion opening, which holder parts fit at least partially displaceably inside one another, and a spring member which preloads the holder parts in a clamping position, it being possible to displace the holder parts with respect to one another counter to the action of the spring member, in such a manner that the insertion openings in the holder parts in one position at least partially correspond to one another and form a continuous insertion opening into which part of the flexible product can be inserted, wherein the two holder parts are of essentially hollow design and together delimit an internal space, the operating holder part being of larger design so that it is slidable over the wall-mounted holder part, and in that one of the holder parts is provided with an auxiliary part which is placed in the internal space, one end of the spring member being supported against the auxiliary part and the auxiliary part shielding the spring member from the internal space in the holder parts, which is accessible via the insertion openings.

2. Clamping device according to claim 1, in which the auxiliary part is a sleeved spring housing which is fixedly connected to the holder part in question and is closed at the end which is remote from the other holder part.

3. Clamping device according to claim 2, in which the spring housing is provided with one or more guide slots, and that holder part which is not provided with the auxiliary part is provided with one or more guide fingers, which guide fingers engage displaceably in the guide slots.

4. Clamping device according to claim 2, in which the spring member is a coil spring which is slender by comparison with the dimensions of the holder parts.

5. Clamping device according to claim 2, in which the spring housing is arranged eccentrically in said holder part provided with said spring housing, in the region of the wall situated opposite said insertion opening in said holder part provided with said spring housing.

6. Clamping device according to claim 2, in which that holder part which is not provided with the spring housing is provided with a projecting spring-stop element, which spring-stop element projects displaceably into the spring housing.

7. Clamping device according to claim 1, in which the operating holder part is provided with an exchangeable cap.

8. Clamping device according to claim 7, in which the operating holder part is provided at its free end with a continuous cutout, and the cap is provided with a projecting clamping edge which corresponds to the cutout.

9. Clamping device according to claim 1, in which clicking means are provided for the purpose of producing an audible signal as soon as the position in which the insertion openings in the holder parts at least partially correspond to one another is reached.

10. Clamping device according to claim 9, in which the clicking means comprise a resilient clicking finger, which is arranged on one holder part, and a projecting clicking stud which is arranged on the other holder part.

11. Clamping device according to claim 1, in which one holder part is provided with a guide stud and the other holder part is provided with a guide groove which extends substantially in the sliding direction.

12. Clamping device according to claim 1, in which a space is formed between the auxiliary part and the holder part which is provided with the auxiliary part, which space serves to accommodate at least part of the other holder part.

13. Clamping device according to claim 1, in which the insertion openings arranged in the holder parts are slot-shaped and their longitudinal direction extends along the circumference of the respective holder parts.

14. Clamping device according to claim 1, in which the holder parts are of cylindrical shape.

15. Clamping device according to claim 1, in which the auxiliary part is a separate component which is fixedly joined to the holder part by adhesive bonding.

16. Clamping device according to claim 1, in which the auxiliary part comprises a sleeve which is fixedly joined to the holder part in question and a fitting piece which is to be arranged on the sleeve.

17. Clamping device according to claim 1, in which the auxiliary part has a recess for accommodating the spring member in that side which faces towards the holder part which is not provided with the auxiliary part.

18. Clamping device according to claim 1, in which connecting means are provided, which are arranged on that holder part which is provided with the auxiliary part and which project into grooves provided on the other holder part.

* * * * *